United States Patent [19]

Choi

[11] 4,011,822

[45] Mar. 15, 1977

[54] BURNER FOR DECARBONIZING ORGANIC CHAR

[75] Inventor: Charles K. Choi, Claremont, Calif.

[73] Assignee: Occidental Petroleum Corporation, Los Angeles, Calif.

[22] Filed: Aug. 11, 1975

[21] Appl. No.: 603,873

[52] U.S. Cl. ..... 110/28 R; 110/28 V; 110/60; 110/81

[51] Int. Cl.[2] ..... F23D 1/00

[58] Field of Search ..... 110/22 R, 22 A, 28 R, 110/28 I, 81, 60

[56] References Cited

UNITED STATES PATENTS

| | | | |
|---|---|---|---|
| 1,063,489 | 6/1913 | Wolvin | 110/28 |
| 2,088,879 | 8/1937 | Stouff | 110/28 |
| 2,218,281 | 10/1940 | Ridder et al. | 110/28 |
| 2,903,980 | 9/1959 | Gorin | 110/28 |

*Primary Examiner*—Kenneth W. Sprague
*Attorney, Agent, or Firm*—Christie, Parker & Hale

[57] ABSTRACT

A burner for decarbonizing organic char in which the particles of char are introduced through a first inlet to a combustion chamber where they are mixed with hot air introduced through one or more additional inlets, the mixture being ignited and burned in the chamber, with the products of combustion being removed from the other end of the chamber through an outlet. Water in the form of a fog is mixed with the hot air as it enters the chamber, the volume of water being controlled to maintain the temperature in the chamber within a predetermined temperature range.

7 Claims, 3 Drawing Figures

Fig. 1
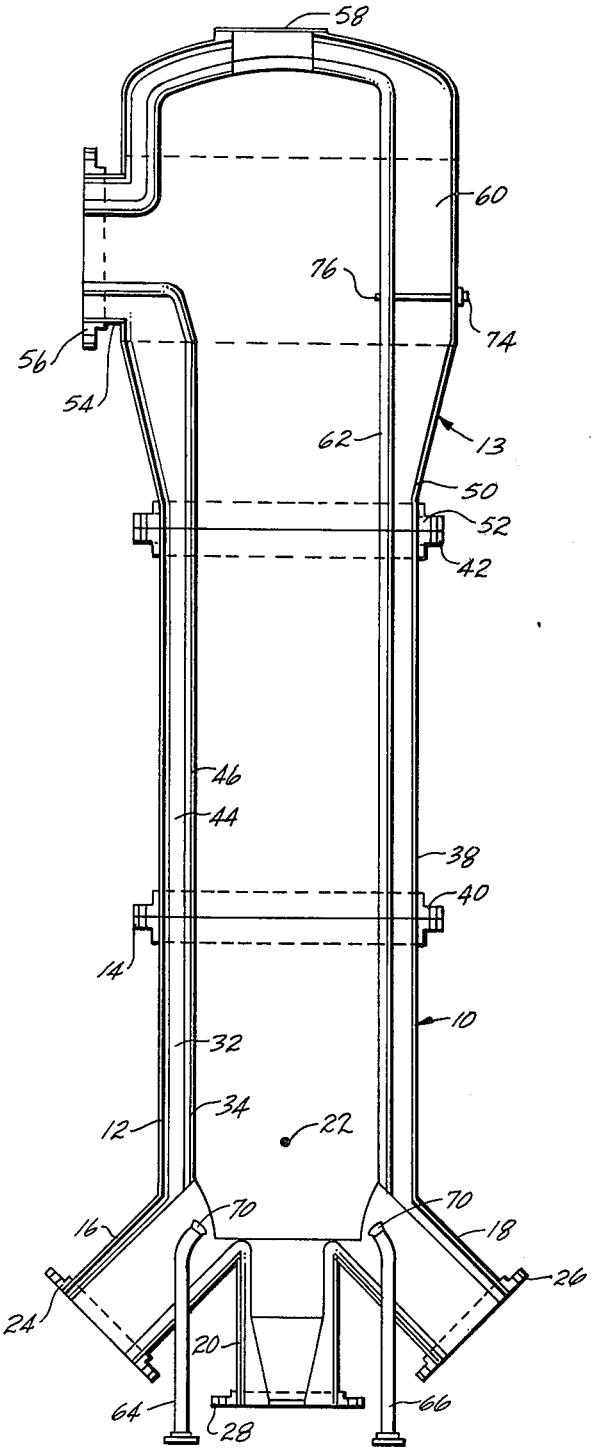
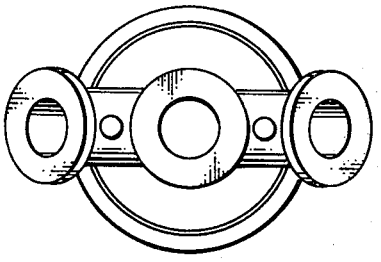
Fig. 2
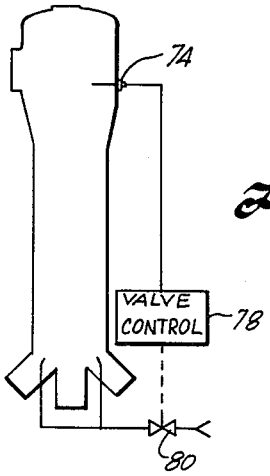
Fig. 3

BURNER FOR DECARBONIZING ORGANIC CHAR

FIELD OF THE INVENTION

This invention relates to a solid waste disposal system, and more particularly to a burner for decarbonizing organic char.

BACKGROUND OF THE INVENTION

The disposal of wastes both from municipal and industrial sources, such as trash, rubbish, garbage, animal wastes, agricultural wastes, and waste of plastic processing operations is rapidly becoming of immense national concern. The cost of disposal ranks third behind public schooling and highways as municipal expense in the United States.

It is estimated that each individual in the country generates between 4 and 6 pounds of waste per day, that the industrial output is equivalent to approximately 5 pounds of solid waste per person per day. Previous methods of mass waste disposal, such as landfill, are becoming impossible, while others such as incineration are costly and result in air pollution problems.

A vast majority of the waste which is presently disposed of contains products which are immediately recyclable back into the economy or products into which the waste can be converted for recycle back to the economy. Directly recyclable constituents are the various metals present, such as aluminum and steel, and glass. For the most part, the organic solid waste fraction is subjected to flash pyrolysis as an operation independent of recovery of the directly recyclable inorganic fraction and any organic portion recovered as pulp. Flash pyrolysis yields solid char, condensible pyrolytic oils and combustible gases.

After pyrolysis of the organic materials, the solid materials in the form of organic char and ash are separated from the gas and liquid constituents. The char, which consists primarily of carbon, and the inorganic ash are fluidized with recycled product gas from the pyrolysis operation and passed through a burner. The burner mixes the char with air to form a combustible mixture that is ignited. The combustion of the char produces additional ash and flue gases. The heat of combustion raises the temperature of the ash to a sufficient temperature for recycling the ash as a heat source in carrying on the flash pyrolysis reaction. At the same time the char is decarbonized to form a flue gas of principally oxides of carbon.

One of the problems in burning the char is to maintain the temperature of the exothermic reaction within certain limits. The ash must be heated sufficiently to carry on the pyrolysis reaction, but must not be heated to a temperature in which the ash becomes molten. It is essential that the ash particles remain in a finely divided state and not coagulate into larger masses, as the particles tend to do if they reach a molten stage.

SUMMARY OF THE INVENTION

The present invention is directed to a burner for decarbonizing the char by mixing it with air and burning the char in the combustion chamber. The combustion reaction is controlled in a manner to maintain the temperature within predetermined limits, for the reasons noted above. This is accomplished, in brief, by providing an elongated combustion chamber in which a mixture of ash and char particles are blown into one end by high pressure recycled gas. Hot air is introduced at the inlet end of the conbustion chamber where it mixes with the stream of ash and char. Once ignited, sufficient heat is released from the reaction to maintain combustion. Temperature of the reaction is regulated by mixing water with the hot air as it enters the combustion chamber, the water being released in the hot air stream through a fogging nozzle. The amount of water is regulated automatically by a temperature sensor which in turn controls a valve which controls the amount of water to maintain the temperature substantially constant.

DETAILED DESCRIPTION OF THE DRAWINGS

For a more complete understanding of the invention, reference should be made to the accompanying drawing, wherein:

FIG. 1 is a cross-sectional view of the char burner;

FIG. 2 is an end view of the burner; and

FIG. 3 is a schematic showing of the control system for the burner.

DETAILED DESCRIPTION

Referring to the drawing in detail, the burner is constructed in three sections. A lower section 10 includes an outer cylindrical metal pipe 12 terminated at its upper end in a flange 14. The lower end includes three inlet pipes 16, 18 and 20. The inlet pipes are of smaller diameter than the pipe 12. The inlet pipe 20 is axially aligned with the pipe 12, while the inlet pipes 16 and 18 have their axes converging at 45° on either side of the axis of the burner on a common point, as indicated at 22. The inlet pipe 16 terminates in a flange 24. Similarly, the inlet pipe 18 terminates in a flange 26 and the inlet pipe 20 terminates in a flange 28. The flanges 24, 26 and 28 provide means for coupling the pipes to suitable conduits (not shown). The interior of the inlet pipes is lined with a suitable heat and corrosion resistant material which insulates and protects the metal pipe. The interior of the lower burner section 10 within the metal pipe 12 is similarly provided with a layer of insulating material 32 with a concentric inner lining of a high temperature resistive material 34.

The intermediate section 11 includes an axially aligned outer metal pipe 38 having a lower flange 40 and an upper flange 42, the lower flange 40 being connected to the flange 14 of the lower section 10. The pipe 38 is similarly lined with an insulating material 44 and an inner fire-resistant lining 46.

The upper section 13 includes an outer metal housing 50 which terminates at the lower end in a flange 52 secured to the flange 42 of the intermediate section 11. The metal housing has an outlet pipe 54 terminating in a flange 56. The upper end of the housing 50 is provided with a removable cover 58. The interior of the housing 50 is provided with an extra thick layer of insulating material 60 plus an inner liner of heat-resistant material 62. The insulating layer and inner liner extend into the outlet pipe 54.

The burner is normally operated by connecting the inlet pipes 16 and 18 to a source of hot air. The inlet pipe 20 is connected to a source of a mixture of ash and char particles separated out from the products of the pyrolysis of soild waste. The ash and char particles are fluidized by mixing with recycled gas. The mixture of the char particles, product gas, and the air forms a highly combustible mixture which, when ignited by a suitable means, such as a pilot or electric spark, produces a combustion reaction with the release of a large amount of heat. The products of combustion are removed by means of the outlet pipe 54. These products include the ash particles, now heated to a high temperature by the release of heat in the combustion reaction, and principally carbon dioxide and carbon monoxide gases typically in the ratio of 4:1.

As pointed out above, it is necessary to the operation of the flash pyrolysis process to provide ash particles at a closely regulated temperature of 1350° F. The ash particles begin to fuse at approximately 1400° F., making it impossible to fluidize the ash effectively. If the temperature of the ash is dropped much below 1350° F., its temperature becomes too low to provide an effective source of heat to promote the pyrolysis reaction. The temperature of the ash is controlled by means of water injection. To this end, a pair of water injection pipes 64 and 66 are provided which extend into the inlet pipes 16 and 18 respectively. The water injection pipes extend through the side wall and are bent at the ends to terminate along the axes of the respective pipes. Each water injection pipe terminates at its inner end in a fogging nozzle 70 within the air inlet pipes.

The fogging nozzles produce a highly dispersed fine mist of water within the combustion chamber. This mist is converted into steam by the heat of combustion within the burner chamber. By absorbing the heat of vaporization from the combustion process, the temperature of the products of combustion is reduced before leaving the chamber. The degree of cooling of course is a function of the rate at which water is injected into the chamber and converted to steam. By regulating this rate of flow, the temperature within the combustion chamber can be regulated. To this end, a temperature sensing transducer unit 74 is mounted in the wall of the upper section 13, the transducer unit having a temperature sensing element 76 which projects into the interior of the combustion chamber. The output signal from the transducer unit 74 is connected to a valve control unit 78 which operates a valve 80 to regulate the rate of flow of water into the injection pipes. Thus a closed loop temperature control system is provided which operates to maintain the temperature within the combustion chamber substantially constant at a pre-set level. Any variation from the desired temperature range causes the valve control unit 78 to increase or decrease the flow of water and thereby bring the temperature back to the desired level.

What is claimed is:

1. A burner for decarbonizing char comprising an elongated combustion chamber; a first inlet pipe at one end of the chamber for directing the char particles into said combustion chamber; at least one second inlet pipe at said one end of the chamber adjacent the first inlet pipe for directing an air stream into the chamber; an outlet at the other end of the chamber; and water injecting means including fogging means for introducing and dispersing water in a finely divided state into the second inlet for controlling the temperature of combustion of the char in the air stream in said combustion chamber and maintaining a substantially uniform temperature profile in said combustion chamber.

2. Apparatus of claim 1 wherein the water injecting means includes a pipe terminating within the chamber along the axis of the second inlet pipe.

3. A burner for decarbonizing char comprising an elongated combustion chamber; a first inlet pipe at one end of the chamber axially aligned with the longitudinal axis of the combustion chamber for directing the char particles into the chamber; at least one second inlet pipe at said one end of the chamber adjacent the first inlet pipe and extending at an acute angle to the longitudinal axis of the chamber, the two axes intersecting a point inside the chamber, said second inlet pipe for directing an air stream into the chamber; an outlet at the other end of the chamber; and water injecting means including fogging means for introducing and dispersing water in a finely divided state into the second inlet pipe for controlling the temperature of combustion of the char in the air stream in the chamber above the point of intersection of the axis to maintain a substantially uniform temperature profile in the chamber.

4. A burner for decarbonizing char comprising and elongated combustion chamber; a first inlet pipe at one end of the chamber for directing the char particles into the chamber; at least one second inlet pipe at said one end of the chamber adjacent the first inlet pipe for directing an air stream into the chamber; an outlet at the other end of the chamber; water injecting means including fogging means for introducing and dispersing water in a finely divided state into the second inlet for controlling the temperature of combustion of the char in the air stream in the chamber and maintaining a substantially uniform temperature profile in the chamber; a valve attached to and in communication with said second inlet for controlling the rate of water injection; means for sensing the temperature at said other end of the chamber, and means responsive to the sensing means for controlling the valve to regulate the rate of water injection to maintain the temperature of combustion of the char at a predetermined level.

5. Apparatus of claim 3 further including a valve attached to and in communication with the water injection means for controlling the rate of water injection, means for sensing the temperature at the other end of the chamber, and means responsive to the sensing means for controlling the valve to regulate the water injection and maintain the temperature of combustion of the char at a predetermined level.

6. Apparatus of claim 3 wherein the water injecting means includes a pipe terminating within the chamber along the axis of the second inlet pipe.

7. A burner as claimed in claim 3 in which the intersection of the axis of the second inlet pipe with the longitudinal axis of the combustion chamber inside the chamber is in proximity to the first inlet pipe.

* * * * *